US008384614B2

(12) United States Patent
Kennedy et al.

(10) Patent No.: US 8,384,614 B2
(45) Date of Patent: Feb. 26, 2013

(54) DEPLOYABLE WIRELESS FRESNEL LENS

(75) Inventors: Timothy F. Kennedy, Houston, TX (US); Patrick W. Fink, Missouri City, TX (US); Andrew W. Chu, Houston, TX (US); Gregory Y. Lin, Friendswood, TX (US)

(73) Assignee: The United States of America as represented by the Administrator of the National Aeronautics and Space Administration, Washington, DC (US)

( * ) Notice: Subject to any disclaimer, the term of this patent is extended or adjusted under 35 U.S.C. 154(b) by 376 days.

(21) Appl. No.: 12/894,749

(22) Filed: Sep. 30, 2010

(65) Prior Publication Data

US 2012/0081265 A1 Apr. 5, 2012

(51) Int. Cl.
*H01Q 15/02* (2006.01)

(52) U.S. Cl. ..... 343/909; 343/915

(58) Field of Classification Search ..... None
See application file for complete search history.

(56) References Cited

U.S. PATENT DOCUMENTS

| | | | | |
|---|---|---|---|---|
| 2,072,262 | A * | 3/1937 | Herzog et al. | 343/797 |
| 2,576,255 | A | 11/1951 | Hudspeth at al. | |
| 3,312,974 | A * | 4/1967 | Lewis | 343/755 |
| 4,608,571 | A | 8/1986 | Luly | |
| 4,926,181 | A | 5/1990 | Stumm | |
| 5,283,591 | A * | 2/1994 | Delmas | 343/755 |
| 5,680,139 | A | 10/1997 | Huguenin et al. | |
| 5,818,395 | A | 10/1998 | Wolcott et al. | |
| 6,313,802 | B1 | 11/2001 | Petersson | |
| 6,720,936 | B1 * | 4/2004 | Koolish et al. | 343/910 |
| 7,009,578 | B2 | 3/2006 | Nolan et al. | |
| 7,126,553 | B1 | 10/2006 | Fink et al. | |
| 7,183,922 | B2 | 2/2007 | Mendolia et al. | |
| 2002/0101390 | A1 * | 8/2002 | Takeuchi et al. | 343/910 |
| 2005/0159187 | A1 | 7/2005 | Mendolia et al. | |
| 2006/0033674 | A1 | 2/2006 | Essig, Jr. et al. | |
| 2008/0111031 | A1 | 5/2008 | Mobrem | |
| 2009/0034050 | A1 | 2/2009 | Bratkovski et al. | |
| 2010/0066638 | A1 * | 3/2010 | Margomenos et al. | 343/909 |

FOREIGN PATENT DOCUMENTS

| | | |
|---|---|---|
| WO | WO 82/00545 | 2/1982 |
| WO | WO 88/10521 | 12/1988 |
| WO | WO 90/01813 | 2/1990 |
| WO | WO 93/19497 | 9/1993 |
| WO | WO 2006/044949 | 4/2006 |
| WO | WO 2008/087388 | 7/2008 |

* cited by examiner

*Primary Examiner* — Trinh Dinh
(74) *Attorney, Agent, or Firm* — Theodore U. Ro

(57) ABSTRACT

Apparatus and methods for enhancing the gain of a wireless signal are provided. In at least one specific embodiment, the apparatus can include a screen comprised of one or more electrically conductive regions for reflecting electromagnetic radiation and one or more non-conductive regions for permitting electromagnetic radiation therethrough. The one or more electrically conductive regions can be disposed adjacent to at least one of the one or more non-conductive regions. The apparatus can also include a support member disposed about at least a portion of the screen. The screen can be capable of collapsing by twisting the support member in opposite screw senses to form interleaved concentric sections.

24 Claims, 4 Drawing Sheets

DEPLOYABLE WIRELESS FRESNEL LENS

ORIGIN OF THE INVENTION

The invention described herein was made by employees of the United States Government and may be manufactured and used by or for the Government of the United States for governmental purposes without the payment of any royalties thereon or therefore.

BACKGROUND OF THE INVENTION

1. Field of the Invention

Embodiments described herein generally relate to wireless gain enhancement. More particularly, embodiments described herein relate to deployable wireless Fresnel lenses.

2. Description of the Related Art

Portable, wireless communication devices often require an increased signal to noise ratio ("SNR"). The need for increased SNR can arise from increased range, higher data rates, and compromised channels—e.g. RF interference and rain fade. Increased SNR can also be required in urban environments because of urban blockage, either on foot or in an automobile, where buildings and materials cause exacerbated fading conditions.

Natural disasters can further diminish the effectiveness of traditional methods of communication thereby creating a need for increased SNR. For example, hurricanes and earthquakes can damage transmission links, such as mobile phone towers, requiring an increased range of communication for remaining undamaged communication links to maintain geographic coverage. Highly critical government communication applications, such as NASA external vehicular activity communications or Department of Defense (DoD) digital battlefield applications, can also require increased SNR. Individuals, such as boaters, hunters, campers, or stranded motorists, may also need an increase in the SNR of their portable communication devices, such as radios, pagers, and mobile phones.

A need exists, therefore, for improved systems and methods for an improved Fresnel lens to increase SNR in wireless communication links, thereby improving the range and performance of wireless devices.

SUMMARY OF THE INVENTION

An apparatus and method for enhancing the gain of a wireless signal are provided. In at least one specific embodiment, the apparatus can include a screen having one or more electrically conductive regions for reflecting electromagnetic radiation and one or more non-conductive regions for permitting electromagnetic radiation therethrough. The one or more electrically conductive regions can be disposed adjacent to at least one of the one or more non-conductive regions. The apparatus can also include a support member disposed about at least a portion of the screen. The screen can be capable of collapsing by twisting the support member in opposite screw senses to form interleaved concentric sections.

In at least one specific embodiment, the method for enhancing the gain of a wireless signal can include activating a wireless communication link to produce a wireless signal. The method can also include placing a Fresnol lens in the transmission path. The Fresnel lens can include a screen having one or more electrically conductive regions for reflecting electromagnetic radiation and one or more non-conductive regions for permitting electromagnetic radiation therethrough. The one or more electrically conductive regions can be disposed adjacent to at least one of the one or more non-conductive regions. The Fresnel lens can also include a support member disposed about at least a portion of the screen. The screen can be capable of collapsing by twisting the support member in opposite screw senses to form interleaved concentric sections. The method can also include amplifying the wireless signal with the Fresnel lens by cancelling out at least a portion of one or more out-of-phase regions of the wireless signal.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

A detailed description will now be provided. Each of the appended claims defines a distinct embodiment of the invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the embodiments will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

Figure 1:
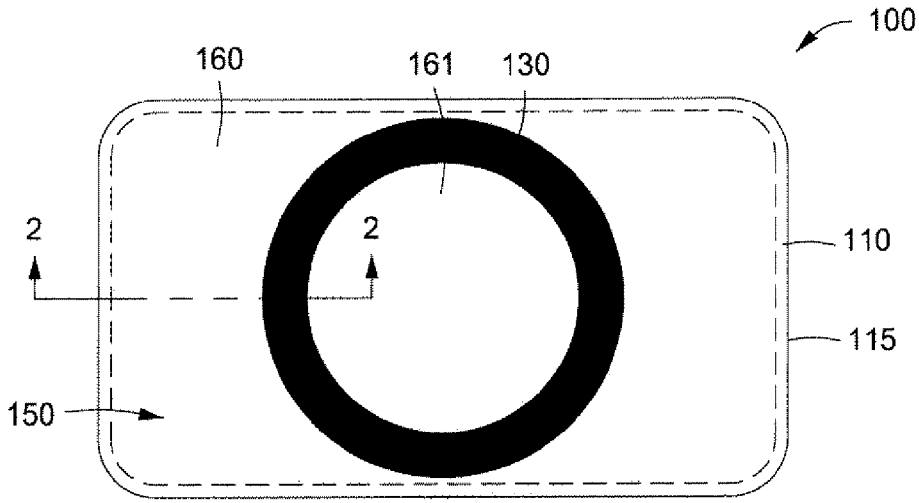
FIG. 1 depicts a side view of an illustrative Fresnel lens, according to one or more embodiments described.

FIG. 1 depicts a side view of an illustrative Fresnel lens or Fresnel zone plate 100, according to one or more embodiments. As used herein, the term "lens" can refer to any three-dimensional structure, through which electromagnetic waves can pass and that uses either refraction or diffraction to control the exiting aperture distribution as a function of its position and shape. As used herein, the terms "Fresnel lens" or "Fresnel zone plate" can refer to a type of lens that produces focusing and imaging of electromagnetic waves using diffraction, rather than refraction. It is noted that a lens and hence, a Fresnel lens, are not antennas. An antenna is a transducer that transmits or receives electromagnetic waves. Conversely, a Fresnel lens does not transmit or receive electromagnetic waves. As stated above and as will be discussed in more detail supra, electromagnetic waves are passed through a Fresnel lens wherein said electromagnetic waves may be focused into Fresnel zone regions.

The Fresnel lens 100 can include one or more screens 150. As used herein, the term "screen" refers to a monolithic body, sheet, or membrane having a thickness that is less than its length and width. The screen 150 can have a length longer than its width, a width longer than its length, or the width and length can be equal. The screen 150 can have any shape or combination of geometrical shapes. The shape of the screen 150 can be symmetric or asymmetric. Illustrative shapes can include, but are not limited to, square, rectangular, triangular, circular, elliptical, pentagonal, hexagonal, other polygonal shapes, non-uniform shapes, or a combination thereof. The screen 150 can be formed of a deformable and/or flexible material or fabric. As used herein, the term "deformable" refers to the ability of the material or fabric to twist, bend, flex, turn, and/or change shape.

The screen 150 can have a total thickness ranging from a low of about 0.01 mm, about 0.5 mm, about 1.5 mm, or about 2.5 mm to a high of about 4 mm, about 7.5 mm, or about 10 mm. The screen 150 can also have a total thickness of from about 0.25 mm to about 8 mm, from about 1 mm to about 6 mm, or from about 2 mm to about 5 mm.

In one or more embodiments, the Fresnel lens 100 can include a plurality of screens 150. For example, the Fresnel lens 100 can include from 1 to 20 screens, 1 to 10 screens, 1 to 5 screens, 2 to 10 screens, 2 to 5 screens, 1 to 3 screens, or 1 to 2 Each screen 150 can be the same or different. For example, in a Fresnel lens 100 having a first and second screen 150, the first screen can be deformable and the second screen can be flexible. In the same example, at least one screen can be deformable and flexible while the other screen is either deformable or flexible.

In one embodiment, the screen 150 can include one or more layers of deformable and/or flexible materials or fabrics that are either conductive or non-conductive. For example, the screen 150 can have from 1 to 20 layers, 1 to 10 layers, 1 to 5 layers, 2 to 10 layers, 2 to 5 layers, 1 to 3 layers, or 1 to 2 layers. Each layer of the screen 150 can be the same or different. For example, in a screen 150 having a first and second layer, the first layer can be deformable and the second layer can be flexible. In the same example, at least one layer can be deformable and flexible while the other layer is either deformable or flexible.

The screen 150 can have one or more electrically conductive regions 130 and one or more non-conductive regions (two are shown 160, 161). The one or more electrically conductive regions 130 can be disposed adjacent to at least one of the non-conductive regions 160, 161. In one embodiment, the one or more electrically conductive regions 130 can be a ring shaped conductive region and can be disposed between an inner non-conductive region 161 and an outer non-conductive region 160. As used herein, the term "conductive" is used interchangeably with the term "electrically conductive." The term "electrically conductive region" as used herein refers to a region having a surface resistance ranging from a low of about 0 ohms per square (Ω/sq) to a high of about 1 Ω/sq. Surface resistance ($R_5$) in Ω/sq can defined by the following equation:

$$R_s = \sqrt{\frac{\omega\mu}{2\sigma}} = \frac{1}{\sigma\delta_s}$$

where σ is the conductivity in siemens per meter (S/m), μ is the magnetic permeability of the medium in henry per meter (H/m), ω is the frequency in radians per second (rads/s), and $\delta_s$ is the skin depth in meters (m). Surface resistance is further discussed and described in D. M. Pozar, *Microwave Engineering*, John Wiley & Sons, New York, 1998. The term "non-conductive region" as used herein refers to a region having little or no electrical conductivity and high resistivity. Specifically, a non-conductive region can be a good dielectric (non-conductor), having electrical properties fitting in the following equation:

$$\left(\frac{\sigma}{\omega\epsilon}\right)^2 << 1$$

where σ is the electrical conductivity in S/m, ω is the radian frequency in rads/s, and ∈ is the electrical permittivity of the medium in farad per meter (F/m). Specifically, the non-conductive region can have electrical properties defined by the following equation:

$$0 \le \left(\frac{\sigma}{\omega\epsilon}\right)^2 \le 0.01$$

where σ, ω, and ∈ are as defined above.

The electrically conductive region 130 can be woven into or otherwise disposed within the screen 150. In another example, the electrically conductive region 130 can be formed by disposing an electrically conductive material or layer on a surface of the screen 150, attaching the electrically conductive material or layer to the surface of the screen 150, embedding the electrically conductive material at least partially within the screen 150, or any combination thereof.

The outer non-conductive region 160 and the inner non-conductive region 161 can be formed by disposing a non-conductive material or layer on the surface of the screen 150, attaching a non-conductive or insulating material to the surface of the screen 150, embedding the non-conductive material at least partially within the screen 150, or any combination thereof, where the screen 150 is non-conductive. Alternatively, the outer non-conductive region 160 and the inner non-conductive region 161 can be or can include the portion of the screen 150 that does not include the electrically conductive region 130.

The electrically conductive material used in the electrically conductive region 130 can be made of or include an electrically conductive fabric, which can include any kind of electronic textile or "e-textile". E-textiles can include any textile that can be applied to the physical manipulation of electrical or electromagnetic signals or radiation; most often, this is associated with devices that incorporate one or more electronic devices. Conductive fabric used in the manufacture of c-textiles can have a surface resistance ranging from a low of about 0 Ω/sq to a high of about 1 Ω/sq and can provide at least partial shielding and/or at least partial blocking of electromagnetic wave transmission or radiation. Many methods for construction of these conductive fabrics exist, such as weaving metal, metalized fiber strands, or other conducting fabric strands into non-conductive fabric. Another method for constructing conductive fabrics includes spraying and/or painting conductive material onto a base layer, where the base layer is usually non-conductive. Metals that can be used in the construction of electronic textiles can include, but are not limited to, copper, nickel, gold, silver, steal, zinc, tin, tungsten, iron, iridium, aluminum, alloys thereof, or other conductive elements. Metalized fiber strands can include polymers coated with metal. Other conducting fabric strands can include electrically conducting polymers or plastics. Electronic textiles can include multiple metalized fibers wrapped together to form electrically conductive strands. Electronic textiles can include nano-tubes or other nano-particles that have advanced electronic function. In another embodiment, the electrically conductive region 130 can be made using metal meshes, such as a copper wire or gold wire mesh.

Just as there can be many different means to creating conductive fabrics for use with c-textiles, numerous non-conductive materials can be used in conjunction with the aforementioned conductive materials. Suitable non-conductive materials can include, but is not limited to, nylon, NOMEX®, KEVLAR®, aromatic polyamide polymers, polyester, cotton, Rip-stop nylon, canvas, other common textiles or materials having bulk electrical properties fitting the description a good non-conductor, or combinations thereof. The non-conductive material can be in the form of a web having air or a vacuum dispersed through non-conductive strands.

Electronic textiles can provide several advantages for portable Fresnel lenses and applications thereof. Electronic textiles are often lightweight with low mass. In addition, they can be both foldable and flexible. E-textiles may be constructed from materials that are resistant to the elements and/or extreme environments. For example, NOMEX®, having excellent thermal, chemical, and radiation resistance, can be used as a base nonconductive e-textile material element. As such, when electrically conductive region 130 includes e-textiles, the Fresnel lens 100 can be lightweight, low mass, foldable, flexible, and/or resistant to the elements.

In another embodiment, the conductivity of the electrically conductive region 130 and conductivity of the non-conductive region 160 can be reversed. For example, the electrically conductive region 130 can be a non-conductive region made of non-conductive fabric, and the non-conductive regions 160, 161 can be conductive regions made of all or mostly conductive fabric.

Still referring to FIG. 1, the Fresnel lens 100 can further include a support member 110 that can be at least partially disposed about the screen 150. The support member 110 is preferably located about or along a perimeter 115 of the screen 150 to provide support or rigidity to the screen 150. The support member 110 can be a single component or body or can include multiple pieces or sections that are joined together. In one embodiment, the support member 110 is a single component that makes a complete loop, i.e. the support member 110 is connected at a first and second end thereof. Because the screen 150 is flexible and deformable, the shape of the support member 110 disposed about the perimeter 115 can define the shape of the Fresnel lens 100. In addition, the support member 110 can stretch the screen 150 and can keep it substantially flat or planar.

The screen 150 and therefore, the Fresnel lens 100 can be configured to be deployable. The term "deployable" as used herein refers to the ability of the screen and therefore, the Fresnel lens, to spread out or extend. The screen 150 and therefore, the Fresnel lens 100 can have an open, extended, spread out, or uncollapsed configuration, where the open configuration of the screen 150 and therefore, the Fresnel lens 100 can have a plurality of shapes, including, but not limited to, generally circular, generally elliptical, generally square, generally triangular, or other shape as required to suit an application or function in which it is used. For example, the Fresnel lens 100 can be non-planar having spherical or parabolic shape. As depicted in FIG. 1, in the open configuration the Fresnel lens 100 can have a generally rectangular shape. For example, the Fresnel lens 100 can have two sets of substantially parallel sides with four interconnecting curved corners.

The Fresnel lens 100 in the open configuration can have a cross-sectional area that can range from a low of about 0.1 $m^2$, about 0.25 $m^2$, about 0.75 $m^2$, about 1 $m^2$, about 1.5 $m^2$, or about 2 $m^2$ to a high of about 5 $m^2$, about 6 $m^2$, about 8 $m^2$, about 10 $m^2$, or about 12 $m^2$. For example, the Fresnel lens 100 in the open configuration can have a cross-sectional area from about 0.5 $m^2$ to about 11 $m^2$, from about 1.25 $m^2$ to about 9 $m^2$, or from about 1.75 $m^2$ to about 7 $m^2$.

The Fresnel lens 100 can also be configured to be portable, i.e. easily carried. In one embodiment, the Fresnel lens 100 can be a low weight and/or low mass device. For example, the Fresnel lens 100 can have a mass ranging from a low of about 0.05 kg to a high of about 5 kg.

Figure 2:
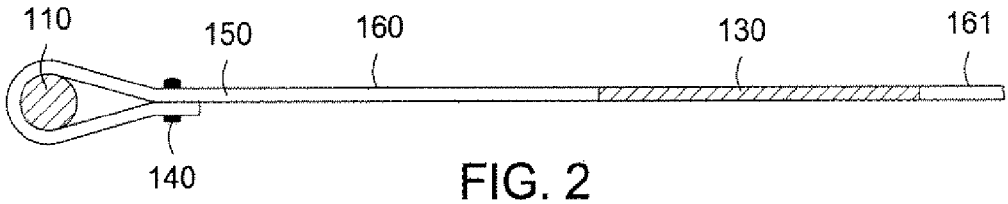
FIG. 2 depicts a partial cross-sectional view of the Fresnel lens depicted in FIG. 1 along line 2-2.

FIG. 2 depicts a partial cross-sectional view of the Fresnel lens 100 depicted in FIG. 1 along line 2-2. One or more layers of the screen 150 can be secured to the support member 110. The screen 150 can be secured to the support member 110 by wrapping the screen 150 around the support and fastening a portion of the screen 150 to another portion of the screen 150 or to the support member 110. The screen 150 can be fastened to itself or the support member 110 using any suitable fastener or combination of fasteners 140. Illustrative fasteners can include, but are not limited to, adhesives, thread, brackets, staples, epoxy, rivets, clamps, or any combination thereof. In one embodiment, the support member 110 can be sewn into at least a portion of the screen 150 using a thread as the fastener 140.

The support member 110 can be formed of a spring-like material. A spring-like material may be described as any elastic body or device that recovers its original shape when released after being distorted. The spring-like material of the support member 110 can be deformable and can be conductive, non-conductive, or partially conductive and partially non-conductive. For example, the spring-like material can include, but is not limited to, plastic, metal, rubber, fiber, fiberglass, carbon, carbon-glass composites, or a combination thereof. Other materials that can be used in the support member include shape memory allows, shape memory polymers, or a combination thereof. Suitable shape memory alloys can include, but are not limited to, Ag—Cd 44/49, Au—Cd 46.5/50, Cu—Al—Ni, Cu—Sn, Cu—Zn, Cu—Zn—Si, Cu—Zn—Al, Cu—Zn—Sn, Fe—Pt, Mn—Cu 5/35, Fe—Mn—Si, Pt alloys, Co—Ni—Al, Co—Ni—Ga, Ni—Fe—Ga, Ti—Pd, Ni—Ti, Ni—Mn—Ga, Fe—Ni, Fe—Pt, Fe—C, Fe—Ni—C, Fe—Cr—C, Au—Mn, In—TI, In—Cd, In—Pb, Fe—Pd, Ni—Al, Ti—Mo, Ti—V, Cu—Al, Ti—Ta, or combinations thereof.

The support member 110 can include, but is not limited to, a circular cross-section, an elliptical cross-section, a square cross-section, a rectangular cross-section, a triangular cross section, polygonal cross-section, and any other cross-sectional shape or combination thereof.

Figure 3:
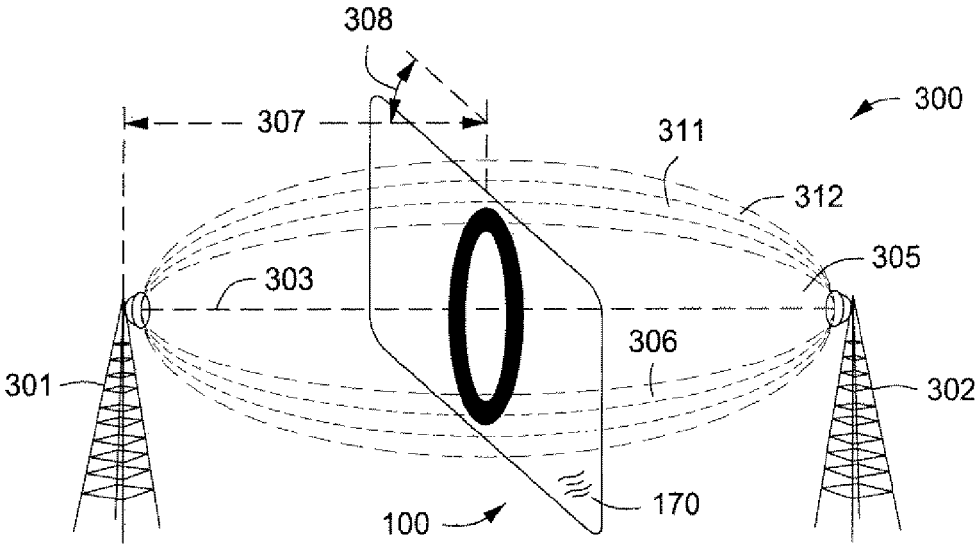
FIG. 3 depicts a schematic diagram of an illustrative communication link utilizing the Fresnel lens depicted in FIG. 1, according to one or more embodiments described.

FIG. 3 depicts a schematic diagram of an illustrative communication link 300 utilizing the Fresnel lens 100 depicted in FIG. 1, according to one or more embodiments. The communication link 300 can include both a transmitting or transmission source 301 and a receiver 302, with a transmission path 303 formed therebetween. In operation, the Fresnel lens 100 through its one or more screens can cancel or block at least a portion of an out-of-phase radiated field produced by the transmission source 301, at any instant of time, passing through a planar cut that is orthogonal to the transmission path 303. The cancellation of the out-of-phase radiation can be accomplished by insertion of the electrically conductive region 130 of the Fresnel lens' 100 one or more screens, such that it blocks or covers one or more Fresnel zone regions (four Fresnel zone regions are shown 305, 306, 311, 312) at a predetermined distance 307 from the transmission source 301 in the transmission path 303. The shape and location of four Fresnel zone regions are depicted diagrammatically as 305, 306, 311, and 312. Fresnel zones are inherent to all wireless communication links. Any transmission from a source or transmitter, such as the transmission source 301, can produce both in-phase and out-of-phase radiation defined by Fresnel zones. Fresnel zones can be concentric ellipsoids of revolution that define volumes of in-phase and out-of-phase radiation from the transmission source 301. The well known equation for calculating a Fresnel zone radius in a wireless communication link, such as the wireless communication link 300 depicted in FIG. 3, at any point P in between the endpoints of the communication link is the following:

$$F_n = \sqrt{\frac{n\lambda d_1 d_2}{d_1 + d_2}} \tag{1}$$

where: $F_n$=the nth Fresnel. Zone radius in meters, $d_1$=the distance of P from one end in meters, $d_2$=the distance of P from the other end in meters, $\lambda$=the wavelength of the transmitted signal in meters. Fresnel zones are further discussed and described in H. D. Hristov, *Fresnel Zones in Wireless Links, Zone Plate Lenses and Antennas*, Artech House, Boston, 2000; and B. Khayatian, Y. Rahmat-Samii, "A Novel Concept for Future Solar Sails: Application of Fresnel Antennas," *IEEE Antennas and Propagation Magazine*, Vol. 46, No. 2, April 2004, pp. 50-63. The former reference also details more complicated wireless link arrangements where the Fresnel zone regions are not as well defined as the communication link depicted in FIG. 3, e.g. when a line-of-sight condition does not exist.

In one or more embodiments and with particular reference to FIG. 3, the in-phase radiation can be defined by a first Fresnel zone region 305 and a third Fresnel zone region 311, and the out-of-phase radiation can be defined by a second Fresnel zone region 306 and a fourth Fresnel zone region 312. As shown, the first Fresnel zone region 305 can bound in-phase radiation and the second Fresnel zone region 306 can bound out-of-phase radiation. Placing the Fresnel lens 100 at the predetermined distance 307 and at a predetermined angle 308 relative to a transmission or receiver source can result in gain enhancement, focusing of radiated energy from the transmission source 301, signal improvement at the receiver 302 relative to that of a communication link without the Fresnel lens 100, or any combination. This result can be accomplished, at least in part, by cancelling the out-of-phase radiation in Fresnel zone region 306. The predetermined angle 308 may be any angle whereby the Fresnel lens 100 is orthogonal to the transmission path. For example, the electrically conductive region 130 can diffract, reflect, interfere with, block, or cancel out the out-of-phase radiation in Fresnel zone 306 to enhance transmission gain and improve SNR in the communication link 300. As such, the Fresnel lens 100 does not require a direct wired connection to the transmission source 301 nor a source of power, i.e. a plug or battery, to perform gain enhancement in the communication link 300.

For the screen 150 having the electrically conductive region 130 that is a single ring shaped conductive region, as depicted in FIG. 1, the increased or enhanced gain can range from a low of about 2 dB, about 3 dB, about 4 dB, or about 5 dB to a high of about 7 dB, about 8 dB, about 9 dB, or about 10 dB. For example, the enhanced gain for the Fresnel lens 100 can range from about 2.5 dB to about 9.5 dB, from about 3.5 dB to about 8.6 dB, or from about 4.5 dB to about 7.5 dB. All the enhanced gain described herein can be achieved in addition to the gain of an antenna used with the transmission source 301. For example, the enhanced gain would be in addition to that achieved by a single microstrip patch antenna, a monopole antenna, a dipole antenna, and/or an antenna array that is used with the transmission source 301. The gain increases achieved by the Fresnel lens 100 are scalable with the transmission strength of the transmission source 301. For example, the Fresnel lens 100 can achieve the same increases in gain with a much stronger transmission source 301.

The Fresnel lens 100 can be designed to provide enhanced gain for a transmitted frequency ranging from a low of about 100 MHz, about 300 MHz, about 500 MHz, or about 700 MHz to a high of about 15 GHz, about 30 GHz, about 45 GHz, or about 60 GHz. For example, the Fresnel lens 100 can be designed to provide enhanced gain for a transmitted frequency of from about 200 MHz to about 55 GHz, from about 400 MHz to about 50 GHz, or from about 600 MHz to about 35 GHz. A specific Fresnel lens 100 can be designed for use in one band. For example, a first Fresnel lens 100 can be designed to provide enhanced gain for a transmitted frequency ranging from 180 MHz to 220 MHz and a second Fresnel lens 100 can be designed to provide enhanced gain for a transmitted frequency ranging from 1 GHz to 5 GHz. A band can include about 10% above a center frequency and about 10% below a center frequency.

The enhanced gain described above can be achieved without the screen 150 being completely flat. For example, the Fresnel lens 100 can achieve the enhanced gain described above when the screen 150 is unsmooth, i.e. wrinkled, creased, crumpled, furrowed, bent, and/or slack. For example, the Fresnel lens 100 can have wrinkles 170 in the screen 150.

Figure 4:
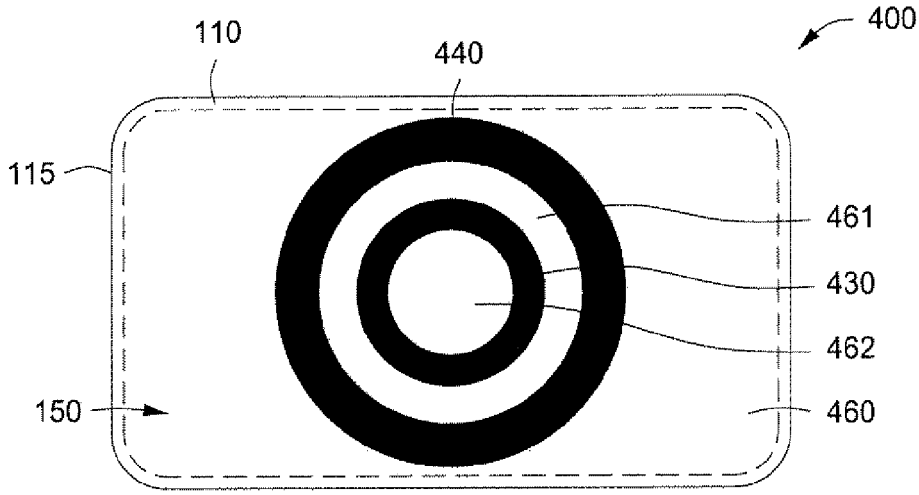
FIG. 4 depicts a side view of another illustrative Fresnel lens having multiple ring shaped conductive regions, according to one or more embodiments described.

FIG. 4 depicts a side view of another illustrative Fresnel lens 400 comprising a screen 150 comprised of multiple ring shaped conductive regions 430, 440, according to one or more embodiments. Similar to the Fresnel lens 100 depicted in FIGS. 1 and 2, the Fresnel lens 400 can have a screen 150, one or more support members 110, and a perimeter 115. The screen 150 of the Fresnel lens 400 can have two or more electrically conductive regions (two are shown 430, 440) and a plurality of non-conductive regions (three are shown 460, 461, 462). At least one of the electrically conductive regions 430, 440 can be disposed adjacent to at least one of the one or more non-conductive regions 460, 461, 462, In one embodiment, an inner ring shaped conductive region 430 can be disposed between an innermost non-conductive region 462 and a middle non-conductive region 461, and an outer ring shaped conductive region 440 can be disposed between the middle non-conductive region 461 and an outermost non-conductive region 460.

With continued reference to FIG. 4, in one embodiment, the inner ring shaped conductive region 430 and the outer ring shaped conductive region 440 can be woven into the screen 150. In another embodiment, the inner ring shaped conductive region 430 and the outer ring shaped conductive region 440 can be attached to the surface of the screen 150. In yet another embodiment, the electrically conductive regions 430, 440 can be formed by disposing an electrically conductive material or layer on the surface of the screen 150, attaching an electrically conductive material or layer to the surface of the screen 150, embedding the electrically conductive material at least partially within the screen 150, or any combination thereof.

With continued reference to FIG. 4, the outer ring shaped conductive region 440 can have a larger outer diameter than the inner ring shaped conductive region 430. In one embodiment, the outer ring shaped conductive region 440 can have a larger width than the inner ring shaped conductive region 430, where the width is defined as the distance between the outer diameter and the inner diameter of a ring. In another embodiment, the outer ring shaped conductive region 440 can have a smaller width than the inner ring shaped conductive region 430. In yet another embodiment, the outer ring shaped conductive region 440 can have a width equal to the width of the inner ring shaped conductive region 430.

With continued reference to FIG. 4, the inner ring shaped conductive region 430 can be shaped and sized to fit, at least partially, in a first out-of-phase portion of a signal transmission, and the outer ring shaped conductive region 440 can be shaped and sized to fit at least partially in a second out-of-phase portion of the signal transmission. For example, the inner ring shaped conductive region 430 can have a width and an outer diameter corresponding to the width and outer diameter of a first out-of-phase Fresnel zone and the outer ring shaped conductive region 440 can have a width and an outer diameter corresponding to the width and outer diameter of a second out-of-phase Fresnel zone. In another embodiment, the inner ring shaped conductive region 430 can have a width and an outer diameter that is smaller than the width and outer diameter of the first out-of-phase Fresnel zone, and the outer ring shaped conductive region 440 can have a width and an outer diameter that is smaller than the width and outer diameter of the second out-of-phase Fresnel zone. In another embodiment, the inner ring shaped conductive region 430 can have a width and an outer diameter that is larger than the width and outer diameter of the first out-of-phase Fresnel zone, and the outer ring shaped conductive region 440 can have a width and an outer diameter that is larger than the width and outer diameter of the second out-of-phase Fresnel zone. In one or more embodiments, the area of the outer ring shaped conductive region 440 can be equal to the area of the inner ring shaped conductive region 430.

With continued reference to FIG. 4, the plurality of non-conductive regions 460, 461, 462 can be the portion of the screen 150 that does not include the electrically conductive regions 430, 440. In another embodiment, plurality of non-conductive regions 460, 461, 462 can be formed by disposing a non-conductive material or layer on the surface of the screen 150, attaching a non-conductive or insulating material to the surface of the screen 150, embedding the non-conductive material at least partially within the screen 150, or any combination thereof, where the screen 15 is non-conductive.

With continued reference to FIG. 4, the innermost non-conductive region 462 can be circular and can be disposed inwardly of and/or proximate to the inner ring shaped conductive region 430. The innermost non-conductive region 462 can be sized to be at least partially disposed within a first in-phase portion of the signal transmission. The middle non-conductive region 461 can be ring shaped and can be disposed between the outer ring shaped conductive region 440 and the inner ring shaped conductive region 430. The middle non-conductive region 461 can be sized to be at least partially disposed within a second in-phase portion of the signal transmission. The outermost non-conductive region 460 can extend from the perimeter 115 to the outer ring shaped conductive region 440. The outermost non-conductive region. 460 can be sized to be at least partially disposed within a third in-phase portion of the signal transmission.

With continued reference to FIG. 4, the middle non-conductive region 461 can have an outer diameter smaller than the outer diameter of the outer ring shaped conductive region 440 and larger than the outer diameter of the inner ring shaped conductive region 430. The middle non-conductive region 461 can have a width equal to the outer ring shaped conductive region 440, equal to the inner ring shaped conductive region 430, or both. Alternatively, the middle non-conductive region 461 can have a width larger than the outer ring shaped conductive region 440 and smaller than the inner ring shaped conductive region 430. The middle non-conductive region 461 can have an area equal to the outer ring shaped conductive region 440, equal to the inner ring shaped conductive region 430, or both. The innermost non-conductive region 462 can have an area equal to the outer ring shaped conductive region 440, equal to the inner ring shaped conductive region 430, or both.

With continued reference to FIG. 4, similar to electrically conductive region 130 in the screen 150 of the Fresnel lens 100, the outer ring shaped conductive region 440 and the inner ring shaped conductive region 430 of the screen 150 of the Fresnel lens 400 can both be made of all or mostly conductive fabric, and the plurality of non-conductive regions 460, 461, 462 can be made of non-conductive fabric. in another embodiment, the outer ring 440 and the inner ring 430 can both be non-conductive regions made of non-conductive fabric and the regions 460, 461, 462 can be conductive regions made of all or mostly conductive fabric.

In operation, the Fresnel lens 400 can be utilized in place of the Fresnel lens 100 in the communication link 300 depicted in FIG. 3. Although not shown in FIG. 3, the communication link 300 can have additional. Fresnel zones defining in-phase and out-of-phase radiation. The Fresnel zones are theoretically infinite and alternately define in-phase radiation and out-of-phase radiation outwardly extending in the radial direction from the transmission path 303. For example, the third Fresnel zone region 311 can extend outwardly in the radial direction from the second Fresnel zone region 306 and define a second in-phase region. Likewise, the fourth Fresnel zone region 312 can extend outwardly in the radial direction from the third Fresnel zone region 311 and define a second out-of-phase region. The Fresnel lens 400 can cancel or block the out-of-phase radiation of a transmitting source 301 by insertion of the two or more electrically conductive regions 430, 440 in the out-of-phase regions, such as those defined by the second Fresnel zone region 306 and the fourth Fresnel zone region 312, at a predetermined distance 307 from the transmission source 301 and at an angle 308 from the source antenna. The distance 307 and the angle 308 can be the same or different from the Fresnel lens 100 used in the communication link 300. Placing the Fresnel lens 400 at the predetermined distance 307 and the predetermined angle 308 can result in gain enhancement and/or improvement over transmission from the transmission source 301 alone. This enhanced gain can be even greater than that of the Fresnel lens 100 having only one electrically conductive region 130 because the Fresnel lens 400 can cancel even more of the out-of-phase radiation with the two or more electrically conductive regions 430, 440 placed in the out-of-phase phase regions defined by the Fresnel zones.

When the Fresnel lens 400 is blocking most of the radiation in the out-of-phase regions Fresnel zones, the enhanced gain can range from a low of about 5 dB, about 6 dB, about 7 dB, or about 8 dB to a high of about 10 dB, about 11 dB, about 12 dB, or about 13 dB. For example, the enhanced gain can range from about 5.5 dB to about 12.5 dB, from about 6.5 dB to about 11.5 dB, from about 7.5 dB to about 10.5 dB, or from about 8.6 dB to 9.6 dB.

In another embodiment, the Fresnel lens 400 may be comprised of three or more electrically conductive regions (not shown). Each increasing electrically conductive region disposed in the out-of-phase portion of a communication link can cause even greater gain enhancement than the Fresnel lens 100 having a single ring shaped conductive region 130 or the Fresnel lens 400 having two ring shaped electrically conductive regions 430, 440. For the Fresnel lens 400 comprised of the three or more electrically conductive regions, four or more non-conductive regions can be interspersed around and between the three or more electrically conductive regions.

Both the Fresnel lens 100 and the Fresnel lens 400 can function as reflectors, i.e. reflecting power in a backward direction. As used here, the term "backward direction" refers to the direction away from the Fresnel lens 100, 400 and opposite the transmission direction of the transmission source 301. The Fresnel lens 100 can have enhanced gain in the backward direction ranging from a low of about 1 dB, about 2 dB, about 3 dB, or about 4 dB to a high of about 6 dB, about 7 dB, about 8 dB, or about 9 dB. For example, the Fresnel lens 100 can have enhanced gain in the backward direction ranging from about 1.5 dB to about 8.5 dB, from about 2.5 dB to about 7.5 dB, or from about 3.5 dB to about 6.5 dB. Likewise, the Fresnel lens 400 can have enhanced gain in the backward direction ranging from a low of about 2 dB, about 3 dB, about 4 dB, or about 5 dB to a high of about 7 dB, about 8 dB, about 9 dB, or about 10 dB. For example, the Fresnel lens 400 can have enhanced gain in the backward direction ranging from about 2.5 dB to about 9.5 dB, from about 3.5 dB to about 8.5 dB, or from about 4.5 dB to about 7.5 dB. The enhanced gain in the backward direction can be higher than that of a single antenna element transmitting in the forward direction.

Figure 5:
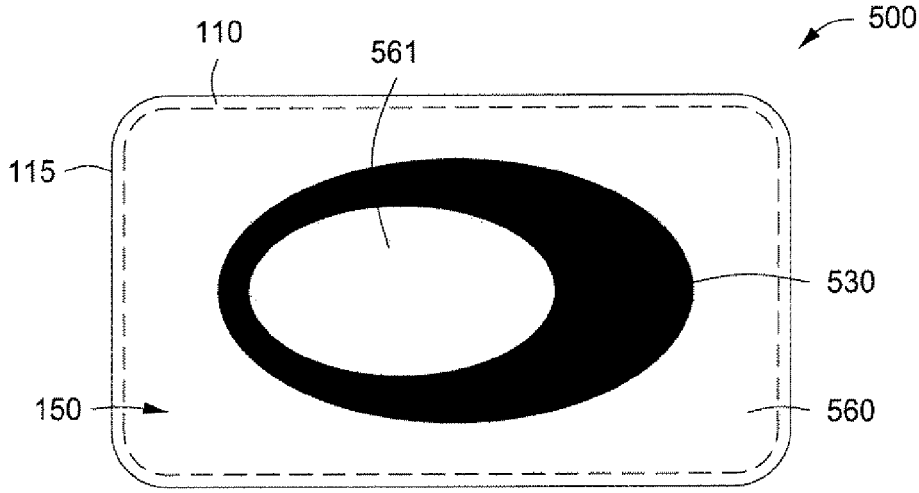
FIG. 5 depicts a side view of yet another illustrative Fresnel lens having an elliptically shaped conductive region, according to one or more embodiments described.

FIG. 5 depicts a side view of yet another illustrative Fresnel lens 500 having an elliptically shaped conductive region 530, according to one or more embodiments. Similar to the Fresnel lens 100 depicted in. FIGS. 1. and 2, the Fresnel lens 500 can have a screen 150, one or more support members 110, and a perimeter 115. The screen 150 of the Fresnel lens 500 can have one or more electrically conductive regions 530 having an elliptical ring shape and one or more non-conductive regions (two are shown 560, 561). The one or more electrically conductive regions 530 can be disposed adjacent to at least one of the non-conductive regions 560, 561. In one embodiment, the electrically conductive region 530 having an elliptical ring shape can be disposed between an inner non-conductive region 561 and an outer non-conductive region 560.

With continued reference to FIG. 5, the outer non-conductive region 560 can extend from the perimeter 115 to the electrically conductive region 530 having an elliptical ring shape. The inner non-conductive region 561 can have an elliptical shape and can be located inside the electrically conductive region 530 having an elliptical ring shape. The inner non-conductive region 561 having an elliptical shape can be located in the center of the electrically conductive region 530 having an elliptical ring shape or can be located off-center. If the inner non-conductive region 561 having an elliptical shape is located off-center, the electrically conductive region 530 having an elliptical ring shape can have a narrow width on a first side and a thick width on a second side.

With continued reference to FIG. 5, the electrically conductive region 530 can be woven into the screen 150. In another embodiment, the electrically conductive region 530 can be formed by disposing an electrically conductive material or layer on a surface of the screen 150, attaching an electrically conductive material or layer to a surface of the screen 150, embedding the electrically conductive material at least partially within the screen 150, or any combination thereof.

With continued reference to FIG. 5, the outer non-conductive region 560 and the inner non-conductive region 561 can be or include the portion of the screen 150 that does not include the electrically conductive region 530. In one embodiment, the outer non-conductive region 560 and the inner non-conductive region 561 can be formed by disposing a non-conductive material or layer on a surface of the screen 150, attaching a non-conductive or insulating material to a surface of the screen 150, or embedding the non-conductive material therein.

With continued reference to FIG. 5, the electrically conductive region 530 can be made of all or mostly conductive fabric and the non-conductive regions 560, 561 can be made of non-conductive fabric. In another embodiment, the conductivity of the electrically conductive region 530 and the non-conductive regions 560, 561 can be reversed. For example, electrically conductive region 530 can be a non-conductive region made of non-conductive fabric and the non-conductive regions 560, 561 can be conductive, regions made of all or mostly conductive fabric.

Design of the geometry of the electrically conductive region 530 having an elliptical ring shape for the Fresnel lens 500 can be more complex than a Fresnel lens having ring shaped conductive regions and can follow techniques for offset fed Fresnel zone ring antennas. Further discussion of these techniques can be found in H. D. Hristov, *Fresnel Zones in Wireless Links, Zone Plate Lenses and Antennas*, Artech House, Boston, 2000.

In operation, the Fresnel lens 500 having the elliptically shaped Fresnel ring 530 can steer a signal in directions off a boresight axis or off boresight, which can be used in, but is not limited to, applications where a communication link, similar to that shown in FIG. 3, is completely or partially blocked by an obstacle. The steering enables the signal to be directed around the obstacle in a fashion that increases the SNR at the receiver versus the link whereby the Fresnel lens is not present. As used herein, the term "boresight axis" or "boresight" refers to the optical axis of a transmission source, or equivalently, the direction of maximum gain of the transmission source. The boresight is depicted as the transmission path 303 in FIG. 3. As used herein, the term "off boresight" refers to any direction not on the optical axis of the transmission source. The Fresnel lens 500 can steer a signal from 0 degrees to a high of about 80 degrees off boresight. For example, the Fresnel lens 500 can steer a signal from about 1 degree to about 70 degrees, from about 5 degrees to about 60 degrees, or from about 10 degrees to about 50 degrees off boresight. In another example, the Fresnel lens 500 can steer a signal to about 40 degrees or more off boresight in two orthogonal planes.

The Fresnel lens 500 having the electrically conductive region 530 having an elliptical ring shape can show improvement in realized gain over a single source antenna in directions and/or angles off boresight, and can simultaneously enhance gain in the forward direction. For the Fresnel lens 500 with the electrically conductive region 530 having an elliptical ring shape, the enhanced gain in directions off boresight can range from a low of about 1 dB, about 2 dB, about 3 dB, or about 4 dB to a high of about 6 dB, about 7 dB, about 8 dB, or about 9 dB. For example, the enhanced gain in directions off boresight can range from about 1.5 dB to about 8.5 dB, from about 2.5 dB to about 7.5 dB, or from about 3.5 dB to about 6.5 dB. The amount of enhanced gain can vary over different angles. The amount of increased or amplified gain at a given angle can depend, at least in part, on the transmission pattern of the transmission source. The improved gain off-boresight can diminish, either linearly or nonlinearly, as the angle off-boresight increases.

The enhanced gain in the forward direction can range from a low of about 2 dB, about 3 dB, about 4 dB, or about 5 dB to a high of about 7 dB, about 8 dB, about 9 dB, or about 10 dB. For example, the enhanced gain in the forward direction can range from about 2.5 dB to about 9.5 dB, from about 3.5 dB to about 8.5 dB, or from about 4.5 dB to about 7.5 dB.

Figure 6:
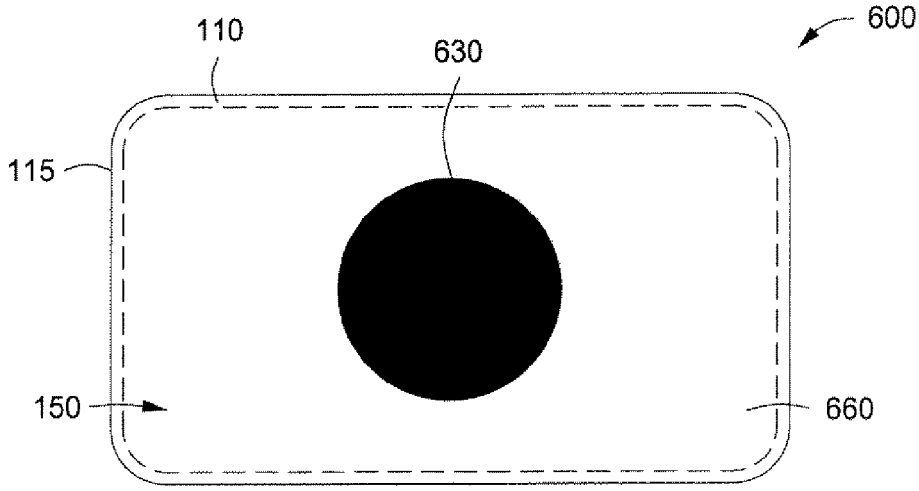
FIG. 6 depicts a side view of still another illustrative Fresnel lens having a circular shaped conductive region, according to one or more embodiments described.

FIG. 6 depicts a side view of still another illustrative Fresnel lens 600 having a circular shaped conductive region 630, according to one or more embodiments. The Fresnel lens 600 can have a screen 150, one or more support members 110, and a perimeter 115. The screen 150 can have a circular shaped conductive region 630 and a non-conductive region 660 extending from the perimeter 115 of the Fresnel lens 600 to the circular shaped conductive region 630. The circular shaped conductive region 630 can be a closed off region configured to be at least partially disposed in an in-phase portion of a Fresnel zone produced by a transmission source. Although not shown, the circular shaped conductive region 630 can be substituted with an elliptical shaped conductive region to provide reflection at a broader and/or different range of angles.

With continued reference to FIG. 6, the circular shaped conductive region 630 can be woven into the screen 150. In another example, the circular shaped conductive region 630 can formed disposing an electrically conductive material or layer on a surface of the screen 150, attaching an electrically conductive material or layer to the surface of the screen 150, embedding the electrically conductive material at least partially within the screen 150, or any combination thereof. The non-conductive region 660 can he or include the portion of the screen 150 that does not include the circular shaped conductive region 630.

With continued reference to FIG. 6, the circular shaped conductive region 630 can be made of all or mostly conductive material and the non-conductive region 660 can be made of non-conductive material. In an alternative embodiment, the circular section depicted as 630 can be a non-conductive region made of non-conductive material and the region depicted as 660 can be a conductive region made of all or mostly conductive material.

In operation, the Fresnel lens 600 can act primarily as a reflector. The Fresnel lens 600 can achieve stronger radiation towards the backward direction than that achieved in the forward direction. For the Fresnel lens 600, the enhanced gain in the backward direction can range from a low of about 2 dB, about 3 dB, about 4 dB, or about 5 dB to a high of about 7 dB, about 8 dB, about 9 dB, or about 10 dB. For example, the enhanced gain in the backward direction can range from about 2.5 dB to about 9.5 dB, from about 3.5 dB to about 8.5 dB, or from about 4.5 dB to about 7.5 dB. Radiation in the backward direction can be improved by at least 8.25 dB over that of the maximum gain of previously computed microstrip patch antennas. The Fresnel lens 600 can still enhance gain in the forward direction. The enhanced gain in the forward direction for the Fresnel lens 600 can range from a low of about 1 dB, about 2 dB, about 3 dB, or about 4 dB to a high of about 5 dB, about 6 dB, about 7 dB, or about 8 dB. For example, the enhanced gain in the forward direction can range from about 1.5 dB to about 7.5 dB, from about 2.5 dB to about 6.5 dB, or from about 3.5 dB to about 5.5 dB.

Other embodiments can be designed by extending the conventional design concepts of the Fresnel lens. In one embodiment, reflector rings in the out-of-phase zones can be replaced to include phase reversal rings (not shown). Phase reversal rings can add energy in phase, thereby reducing energy loss. In a further embodiment, frequency selective surfaces can be utilized to selectively control multiple operational bands (not shown). For example, certain regulated bands can be blocked. In another example, energy can only be transmitted at one or more limited frequency bands. The frequency selective surfaces can be made out of e-textiles.

Figure 7:
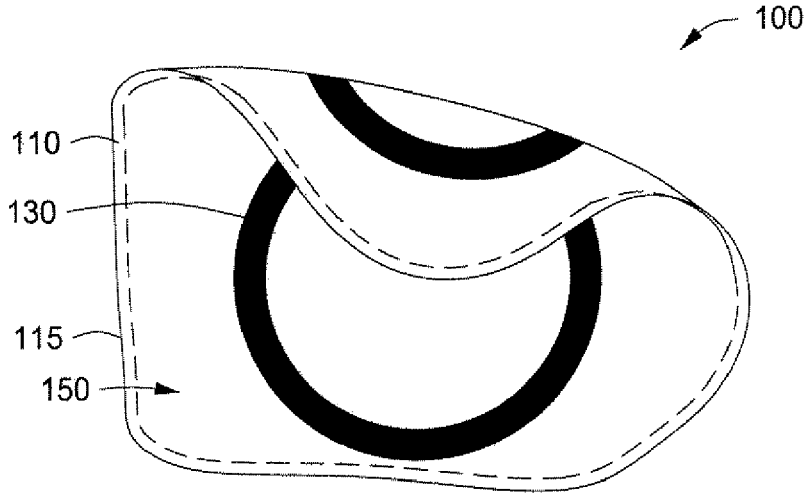
FIG. 7 depicts a side view of the Fresnel lens depicted in FIG. 1 in a partially folded configuration, according to one or more embodiments described.
Figure 8:
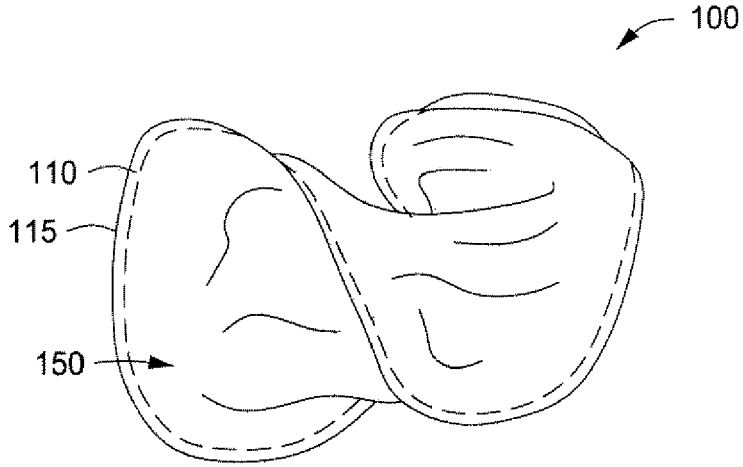
FIG. 8 depicts a side view of the Fresnel lens depicted in FIG. 1 in a partially collapsed configuration, according to one or more embodiments described.
Figure 9:
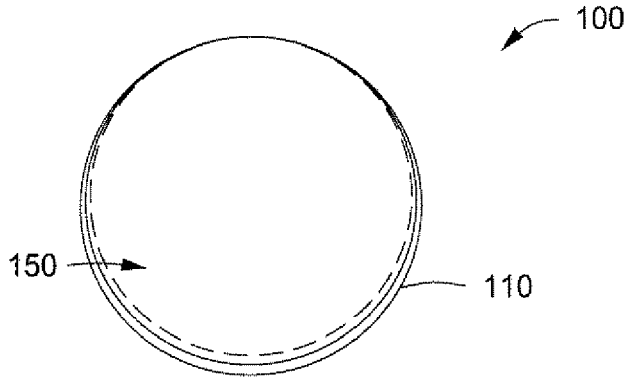
FIG. 9 depicts a side view of the Fresnel lens depicted in FIG. 1 in a compact configuration, according to one or more embodiments described.

FIGS. 7-9 show at least one embodiment for collapsing the Fresnel lens 100 into a reduced volume or a compact configuration. One method of collapsing the Fresnel lens 100 can comprise grasping the support member 110 with the screen 150 attached thereto at its extreme or opposing ends or points, twisting the ends in opposite screw senses while simultaneously bringing the ends toward each other. Opposite screw senses as used herein refers to rotation in opposite directions.

FIG. 7 depicts a side view of the Fresnel lens 100 depicted in FIG. 1 in a partially folded configuration, according to one or more embodiments. As the ends are twisted together, the Fresnel lens 100 can be partially folded on itself, as depicted.

FIG. 8 depicts a side view of the Fresnel lens 100 depicted in FIG. 1 in a partially collapsed configuration, according to one or more embodiments. As the ends are twisted further, the Fresnel lens 100 can begin to collapse into a spiral looking shape as depicted in FIG. 8.

FIG. 9 depicts a side view of the Fresnel lens 100 depicted in FIG. 1 in a compact or closed configuration, according to one or more embodiments. Once the ends are completely twisted and folded, the folds of the Fresnel lens 100 can be formed into a number of interleaved sections consisting of generally circular loops. The generally circular loops can be pressed down to form the compact configuration shown in FIG. 9. The Fresnel lens 100 can easily and conveniently collapse into the compact configuration for storage when not in use, as is illustrated in FIG. 9. The general structure and method of collapsing as illustrated in FIGS. 7-9 can be utilized for the Fresnel lenses 400, 500, and/or 600, as well. An alternative method of collapsing the Fresnel lenses can involve one or more folds along predete mined creases.

The Fresnel lens 100 can have a plurality of shapes in the compact configuration, including, but not limited to, generally polygonal, generally elliptical, generally square, generally triangular, or other shape as required. As depicted in FIG. 9, the Fresnel lens 100 can have a generally circular shape in the compact configuration. The shape of the Fresnel lens 100 in the compact configuration can depend, at least in part, on the shape required for the uncollapsed configuration and the manner in which the Fresnel lens 100 is folded.

Figure 10:
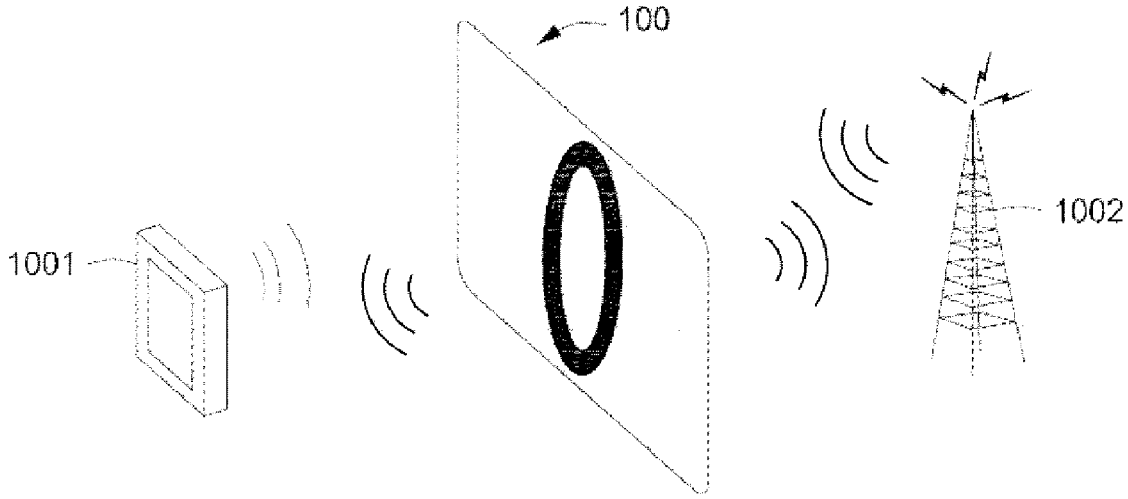
FIG. 10 depicts a schematic diagram of an illustrative wireless device utilizing the Fresnel lens 100 depicted in FIG. 1 to enhance the gain of one or more signals sent to and from the wireless device, according to one or more embodiments described.

FIG. 10 depicts a schematic diagram of an illustrative wireless device 1001 placed proximate to a Fresnel lens 100 or in a predetermined Fresnel zone region to enhance the gain of a signal transmitted from the wireless device 1001 as well as to enhance the gain of a signal received by the wireless device 1001 which has been transmitted by one or more transceivers 1002 (e.g., a cell phone tower, a wireless router, etc.), according to one or more embodiments. As described infra, placing the Fresnel lens 100 at a predetermined distance and at a predetermined angle relative to a transmission or receiver source can result in gain enhancement, focusing of radiated energy from the transmission source, signal improvement at the receiver relative to that of a communication link without the Fresnel lens, or any combination. FIG. 10 also illustrates the distinction that the Fresnel lens 100 is not an antenna. Antennas are operably integrated on the one or more wireless devices 1001 and the one or more transceivers 1002. FIG. 10 also illustrates the fact that no direct wire connection(s) are required between the Fresnel lens 100 and the one or more wireless devices 1001. The Fresnel lens 100 can be used to enhance the signal gain of one or more wireless devices 1001 transmitted to one or more transceivers 1002. Further, the Fresnel lens 100 can be used to enhance the signal gain of one or more transceivers 1002 transmitted to one or more wireless devices 1001. The wireless devices 1001 can include, but are not limited to, mobile phones, srnartphones, tablet devices, personal digital assistants (PDA), cameras, global positioning systems (GPS), wireless adapters or PCI cards for computing devices (e.g. Bluetooth® or 802.11 devices), radios, transmitters, or any combination thereof.

Certain embodiments and features have been described using a set of numerical upper limits and a set of numerical lower limits. It should be appreciated that ranges from any lower limit to any upper limit are contemplated unless otherwise indicated. Certain lower limits, upper limits, and ranges appear in one or more claims below. All numerical values are "about" or "approximately" the indicated value, and take into account experimental error and variations that would be expected by a person having ordinary skill in the art. As used herein in the claim(s), when used in conjunction with the word "comprising", the words "a" or "an" mean one or more.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A Fresnel lens, comprising:

a screen having one or more electrically conductive regions for reflecting electromagnetic radiation and one or more non-conductive regions for permitting electromagnetic radiation therethrough, wherein the one or more electrically conductive regions are disposed adjacent to at least one of the one or more non-conductive regions; and a support member disposed about at least a portion of the screen, wherein the screen is capable of collapsing by twisting the support member in opposite screw senses to form interleaved concentric sections.

2. The Fresnel lens of claim 1, wherein the one or more non-conductive regions are comprised of two or more non-conductive regions, and wherein at least one of the one or more electrically conductive regions comprises a ring shaped conductive region disposed between at least two of the two or more non-conductive regions.

3. The Fresnel lens of claim 2, wherein the screen is adapted to increase gain by about 5 dB to about 11 dB in a forward direction.

4. The Fresnel lens of claim 1, wherein the one or more non-conductive regions are comprised of two or more non-conductive regions, wherein the one or more electrically conductive regions are comprised of two or more electrically conductive regions, and wherein at least two of the two or more electrically conductive regions each comprise ring shaped conductive regions, each disposed between at least two of the two or more non-conductive regions.

5. The Fresnel lens of claim 4, wherein the screen is adapted to increase gain by about 8 dB to about 13 dB in a forward direction.

6. The Fresnel lens of claim 1, wherein the one or more electrically conductive regions each comprise an elliptically shaped conductive region, wherein the one or more non-conductive regions each comprise an elliptically shaped non-conductive region, and wherein at least one of the one or more elliptically shaped non-conductive regions is disposed within at least one of the one or more elliptically shaped conductive regions.

7. The Fresnel lens of claim 6, wherein the screen is adapted to steer a signal transmission from about 0 degrees to about 50 degrees off boresight.

8. The Fresnel lens of claim 6, wherein the screen is adapted to increase gain from about 3 dB to about 9 dB in a forward direction.

9. The Fresnel lens of claim 1, wherein at least one of the one or more electrically conductive regions comprises a circular shaped conductive region surrounded by the one or more non-conductive regions.

10. The Fresnel lens of claim 9, wherein the screen is adapted to increase gain from about 2 dB to about 10 dB in a backward direction.

11. The Fresnel lens of claim 1, wherein the screen is deployable.

12. The Fresnel lens of claim 1, wherein the screen is flexible.

13. The Fresnel lens of claim 1, wherein the screen has a thickness between about 0.1 mm and about 4 mm.

14. The Fresnel lens of claim 1, wherein the support member is formed of a deformable spring-like material selected from a group consisting of metal, fiberglass, carbon, and carbon-glass composites.

15. The Fresnel lens of claim 1, wherein the screen is capable of collapsing by twisting opposing ends of the support member in opposite screw senses while bringing the opposing ends toward each other to form the interleaved concentric sections.

16. The Fresnel lens of claim 1, wherein the screen has a collapsed configuration and an uncollapsed configuration, and wherein the screen is substantially flat in the uncollapsed configuration.

17. The Fresnel lens of claim 1, wherein the one or more electrically conductive regions are comprised of two or more electrically conductive regions, and wherein at least one of the one or more non-conductive regions comprises a ring shaped conductive region disposed between at least two of the two or more electrically conductive regions.

18. The Fresnel lens of claim 1, wherein at least one of the one or more electrically conductive regions comprises a phase reversal ring.

19. The Fresnel lens of claim 1, wherein the Fresnel lens is operated comprising the steps of:

activating a wireless communication link to produce a wireless signal wherein the wireless signal travels in a transmission path;

placing the screen in the transmission path; and enhancing the gain of the wireless signal with the screen by cancelling out at east a portion of one or more out-of-phase regions of the wireless signal.

20. The Fresnel lens of claim 19, wherein the Fresnel lens is operated further comprising the step of placing a wireless device proximate to the screen.

21. The Fresnel lens of claim 20, wherein the step of placing a wireless device proximate to the screen is comprised of placing the wireless device in a predetermined Fresnel zone region.

22. A method for enhancing the gain of a wireless signal comprising:

activating a wireless communication link to produce a wireless signal;

placing a Fresnel lens in the transmission path, the Fresnel lens comprising:

a screen having one or more electrically conductive regions for reflecting electromagnetic radiation and one or more non-conductive regions for permitting electromagnetic radiation therethrough, wherein the one or more electrically conductive regions are disposed adjacent to at least one of the one or more non-conductive regions; and a support member disposed about at least a portion of the screen, wherein the screen is capable of collapsing by twisting the support member in opposite screw senses to form interleaved concentric sections;

and enhancing the gain of the wireless signal with the Fresnel lens by cancelling out at least a portion of one or more out-of-phase regions of the wireless signal.

23. The method of claim 22, wherein enhancing the gain of the wireless signal comprises increasing the gain of the signal from about 2 dB to about 11 dB in a forward direction.

24. The method of claim 22, further comprising the step of placing a wireless device proximate to the Fresnel lens.

* * * * *